United States Patent [19]

Madnick et al.

[11] Patent Number: 4,792,803

[45] Date of Patent: Dec. 20, 1988

[54] TRAFFIC MONITORING AND REPORTING SYSTEM

[76] Inventors: Peter A. Madnick, 627 Valley Oak La.; Russell W. Sherwood, 1798 Allepo Ct., both of Thousand Oaks, Calif. 91360

[21] Appl. No.: 59,769

[22] Filed: Jun. 8, 1987

[51] Int. Cl.[4] ..... G08G 1/09

[52] U.S. Cl. ..... 340/905

[58] Field of Search ..... 340/905, 870.12; 364/436, 437, 438; 455/54, 228

[56] References Cited

U.S. PATENT DOCUMENTS

| | | | |
|---|---|---|---|
| 2,429,607 | 10/1947 | Capen | 455/603 X |
| 4,023,017 | 5/1977 | Ceseri | 340/905 X |
| 4,435,843 | 3/1984 | Eilers et al. | 455/228 X |
| 4,561,115 | 12/1985 | Pfeifer | 340/905 X |

OTHER PUBLICATIONS

Ueki, "Electronics Controls Traffic, Ensures Safety in Japan's Longest Expressway Tunnel", *Journal of Electrical Engineers,* Apr. 1976, pp. 23–26.

Bailey, "The BBC CARFAX System", 2nd International Conference on Automotive Electronics, London, England, (29 Oct.–2 Nov. 1979), pp. 224–228.

*Primary Examiner*—Joseph A. Orsino
*Assistant Examiner*—Brian R. Tumm
*Attorney, Agent, or Firm*—Jack C. Munro

[57] ABSTRACT

A traffic reporting system which is to be in the form of a service that is to be subscribed to by each individual. Each individual is to have a receiver and this receiver is to be located within the individual's vehicle. This receiver is to have a plurality of activatable buttons with each button to correspond to a particular zone of a specific overall geographical area. If the individual presses a button, a continuous message will be announced informing that individual of pertinent information on traffic conditions relating to that specific zone. Each message for each zone is automatically frequently updated.

3 Claims, 1 Drawing Sheet

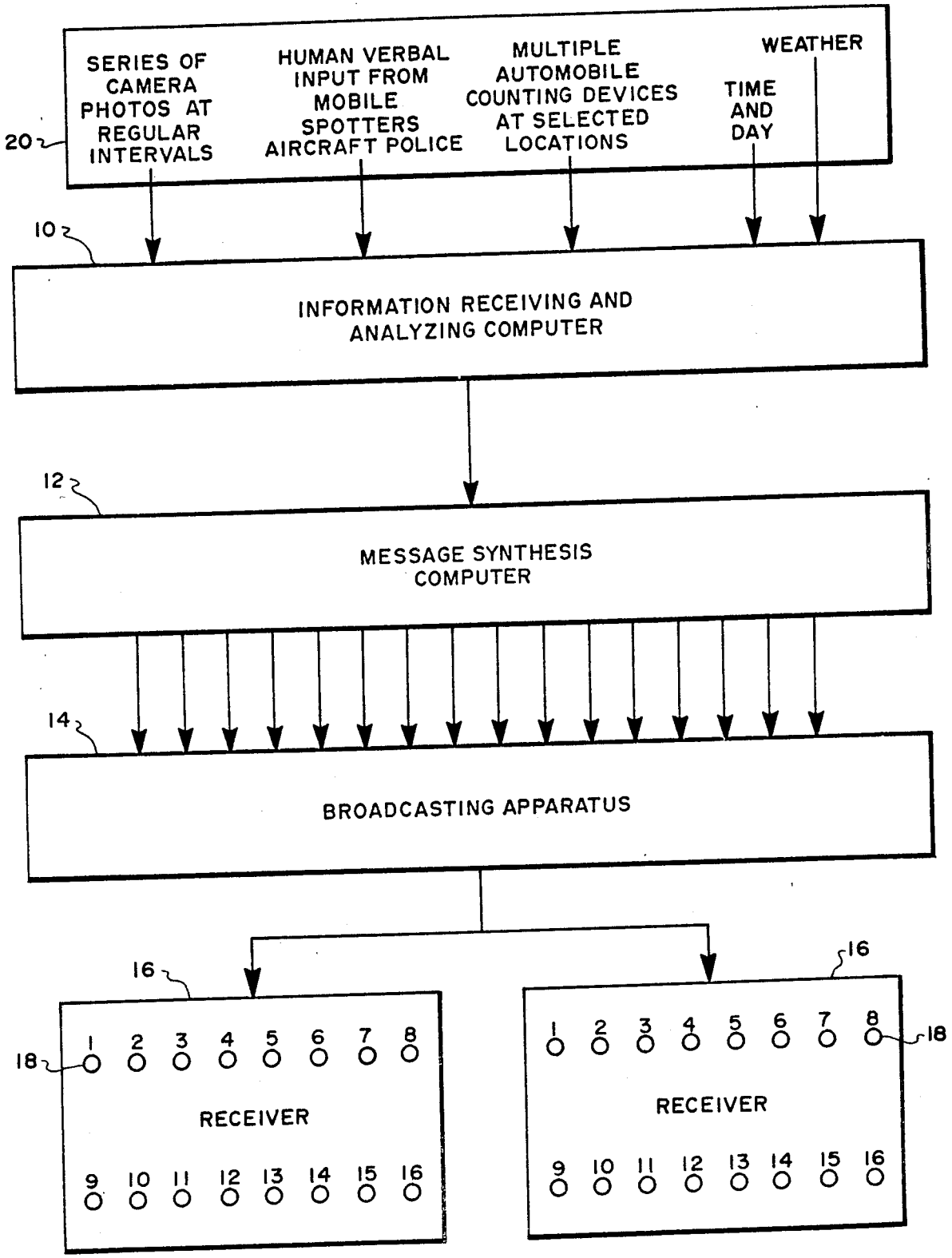
SERIES OF CAMERA PHOTOS AT REGULAR INTERVALS
HUMAN VERBAL INPUT FROM MOBILE SPOTTERS AIRCRAFT POLICE
MULTIPLE AUTOMOBILE COUNTING DEVICES AT SELECTED LOCATIONS
TIME AND DAY
WEATHER
20
10
INFORMATION RECEIVING AND ANALYZING COMPUTER
12
MESSAGE SYNTHESIS COMPUTER
14
BROADCASTING APPARATUS
16
18
1 2 3 4 5 6 7 8
RECEIVER
9 10 11 12 13 14 15 16
16
18
1 2 3 4 5 6 7 8
RECEIVER
9 10 11 12 13 14 15 16

TRAFFIC MONITORING AND REPORTING SYSTEM

BACKGROUND OF THE INVENTION

The field of this invention relates to reporting systems and more particularly to an information collecting system for disclosing of pertinent information to a particular individual on traffic conditions within a particular geographical zone.

Within any reasonably sized city, traffic conditions are important to any motor vehicle operator in order to avoid traffic jams and minimize time spent in operation of the motor vehicle. In order to avoid any traffic jam or traffic slowdown, advance warning is required so the individual can plan on avoiding the area where the undesirable traffic situation exists. Presently, the way an undesirable traffic situation is detected is when the individual comes upon the situation. At that time, it is hoped that the individual can change his or her direction of movement in order to bypass this undesirable traffic situation. One of the principle reasons that such undesirable traffic situations occur is due to accidents.

Another way to assist operators of motor vehicles in knowing about traffic conditions is through the use of radio traffic reports. Within cities of any significant size, at least one or more radio stations will give out reports on traffic at regular intervals during peak traveling hours. Generally this is in the early morning hours and in the late afternoon hours. These traffic reports are created by radio station personnel who are in motor vehicles themselves or other personnel who are in helicopters or airplanes. Also, these reports take into consideration police reports as well as reports from individuals that are kind enough to report an undesirable traffic situation to the radio station.

Although these reports can be quite helpful to individual operators of motor vehicles, for the most part such reports are "spotty". It appears that generally these reports are to provide entertainment more than actually providing significant useful information to operators of motor vehicles.

It is believed that there is a need to provide a comprehensive traffic reporting system such that any operator of a motor vehicle can immediately receive an updated accurate report on traffic conditions concerning any particular zone of an overall geographical area of the city. It is also believed that to the present day there has not been utilized such an automated system within any city in the entire world.

SUMMARY OF THE INVENTION

The traffic monitoring and reporting system of the present invention is to utilize an information receiving and analyzing computer. This computer is to be preprogrammed with data concerning an overall geographical area. Throughout this geographical area there is to be located a mass of sensors. Typical sensors would be cameras and counters. The counters are to count the number of vehicles that pass over a precise location within a certain period of time. The outputs of these sensors are to be transmitted to the information receiving and analyzing computer. Information from human observations, mobile spotters, aircraft, police, etc., is also to be supplied to the information receiving and analyzing computer. The time of the day, as well as the day of the week, and weather is also to be transmitted to this computer. The function of this computer is to apply the received data to specific sections of this overall geographical area. These specific sections will be referred to as "zones". The computer then generates an exact view of present traffic conditions based on the information received. These generated results are then transmitted to a message synthesis computer. This message synthesis computer in turn produces multiple messages, one message for each zone. These multiple messages are then broadcast over the airwaves and are to be picked up, when desired, by a receiver with there being a receiver in each individual's motor vehicle. If the individual wishes to receive information on a particular zone, the individual only needs to activate a button or the receiver for that particular zone at which time an up-to-date current message regarding traffic conditions in that zone is then verbally transmitted to the individual.

The primary objective of the present invention is to construct a system which is to make available to each operator of a motor vehicle within an overall specific geographical area, such as a city, the present conditions of traffic within specific zones in that geographical area so as to forewarn the operator of that motor vehicle of any undesirable traffic situation.

BRIEF DESCRIPTION OF THE DRAWING

The FIGURE shows in block diagram form the traffic reporting system of the present invention.

DETAILED DESCRIPTION OF THE PREFERRED EMBODIMENT

Referring particularly to the drawing, there is depicted in block diagram form an information receiving and analyzing computer 10. It is generally conceived that the data being transmitted into the computer 10 will be through the use of telephone lines (not shown). The computer 10 will be aware of the time of day and the day of the week plus weather conditions. Computer 10 will have been preprogrammed that during certain times of the day and during inclement weather traffic flow tends to be heavier, such as six-thirty to nine-thirty in the morning and three to seven o'clock in the afternoon. Also, the computer 10 will be programmed to be aware that this heavy flow of traffic usually occurs only Monday through Friday and not on Saturday and Sunday.

The computer 10 will be preprogrammed to have an internal map of the overall geographical area that is being screened. Within the program of the computer, the location of each sensor will be noted. At carefully selected geographical locations there will be installed a counting sensor which are commonly referred to as a "loop detector". This counting sensor will calculate the number of motor vehicles being driven across this sensor within a given period of time. The output from this sensor is transmitted to the computer 10. The output of these sensors will be supplied on a regular basis to the computer 10 such as about every two minutes or less.

Also supplied to the computer 10 is input from a plurality of cameras again located at carefully selected geographical locations. This input will be evaluated by video image processing equipment prior to being inserted into the computer 10. Also, human verbal input is to be evaluated by human beings and inserted into the computer 10. This human verbal input is to be from aircraft, police reports, as well as members of the general public and individuals that are moving within the traffic themselves. It is to be understood that the input from these sensors will also be on a frequent updating procedure, within two minutes or so.

The computer 10 will be preprogrammed with each location having a data area assigned to it allowing a running list of the speed and flow data of the motor vehicles traversing that location within the last two hours. The data received from these sensors is to be utilized within the computer 10 to form an internal plot in the form of a graph of the road conditions with one axis being location and the other axis being speed and flow data. The old data and the current data represent a group of graphs that together will indicate changing conditions on selected routes by the variations with respect to time. This new data will make apparent the changing road conditions along the length of a given roadway allowing generation of both level of service data for the roadway at the present time as well as predictions of the road conditions for a few moments later in time. This process would be repeated, of course, for all of the roadways being observed by the system of this invention. This computer generated level of service data is next combined with other data such as incidents from mobile spotters, aircraft, police, etc., providing an overall level of service calculation. As previously mentioned, this incident and other data would be manually entered and tagged to a specific section of roadway. The output of the computer 10, this overall level of service, is transmitted to the message synthesis computer 12.

The input from these sensors is depicted generally by box 20 in the drawings. It is to be understood that box 20 represents a plurality of each type of sensor, i.e. multiple weather sensors, multiple camera sensors, etc.

The message synthesis computer 12 is conventionally available such as is sold under the trademark of DECtalk of Digital Equipment Corporation. Within the computer 12 there are a large number of previously recorded phrases to verbally describe the roadway situation in terms of commuter useful information. This data base of phrases would contain items such as road names, travel speeds, travel times, alternate routes and other words and phrases such that intelligent English sentences could be formed by sequentially combining together these phrases into a complete thought. This library of the computer 12 would also contain punctuational information to provide correct spacing of words and phrases such that a natural rhythm could be maintained. This system would result in a text version of the message that is to be broadcast.

These messages are formed within the computer 12 with therebeing a separate message for each geographically designated zone. In referring to the drawing it can be seen that there are sixteen in number of zones. Therefore, there are sixteen in number of messages that are being conducted from the computer 12 to the broadcasting apparatus 14. The broadcasting apparatus 14 is deemed to be conventional and is designed to transmit all sixteen messages simultaneously over a single band width (or multiple band widths). Each user of the system of the present invention has acquired a receiver 16. This receiver 16 will normally be mounted within the motor vehicle. When this receiver is turned "on", the user can selectively push any one of the sixteen in number of buttons 18 which are mounted on the face of the housing of the receiver 16. Each button 18 is to be designated for a particular zone of the overall geographical area which is being covered. The user will have available to him or her information denoting to that user which button 18 applies to which zone. If the user is moving from one zone into another zone, the user only needs to punch a button 18 that is directed to the new zone to receive advance warning of traffic data for the new zone within which the user is to be moving.

It is considered to be within the scope of this invention that the material being broadcast is not verbal but signals that could be displayed on a visual monitor or utilized by an onboard computer.

What is claimed is:

1. A traffic monitoring and reporting system comprising:

a plurality of sensors, each said sensor located at a designated location and designed to produce an output based upon traffic conditions at its designated location;

an information receiving and analyzing computer, said output of each said sensor to be transmitted to and received by said information receiving and analyzing computer, said information receiving and analyzing computer to generate results based on said output of each said sensor, said results being organized into a plurality of different zones within an overall geographical area;

a message synthesis computer to receive the results of said information receiving and analyzing computer, said message synthesis computer to produce a plurality of different messages, each said message to be specially oriented to one of said zones;

transmitting of the output of said message synthesis computer to a broadcasting means, said broadcasting means for transmitting of said different messages by radio waves; and a plurality of receivers, each said receiver to be adapted to be located within a vehicle with therebeing a plurality of vehicles, each said receiver having means to individually select and announce any one of said messages.

2. The traffic monitoring and reporting system as defined in claim 1 wherein:

said sensors including at least one camera.

3. The traffic monitoring and reporting system as defined in claim 1 wherein:

said sensors including at least one counter for counting the number of vehicles that move across one of said designated locations within a period of time.

* * * * *